US009182134B2

(12) United States Patent
Ariga

(10) Patent No.: US 9,182,134 B2
(45) Date of Patent: Nov. 10, 2015

(54) AIR CONDITIONER HAVING POSITIVE TEMPERATURE COEFFICIENT HEATER

(75) Inventor: Tohru Ariga, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 769 days.

(21) Appl. No.: 12/953,990

(22) Filed: Nov. 24, 2010

(65) Prior Publication Data

US 2011/0123181 A1 May 26, 2011

(30) Foreign Application Priority Data

Nov. 26, 2009 (JP) ..... 2009-268882

(51) Int. Cl.

| | |
|---|---|
| ***H05B 3/78*** | (2006.01) |
| ***F24F 1/02*** | (2011.01) |
| ***F24F 11/00*** | (2006.01) |
| ***H05B 1/02*** | (2006.01) |

(52) U.S. Cl.

CPC ..... *F24F 1/022* (2013.01); *F24F 11/006* (2013.01); *H05B 1/028* (2013.01); *F24F 2221/34* (2013.01); *F24F 2221/54* (2013.01)

(58) Field of Classification Search

CPC .... F25B 49/00; F25B 21/00; F25B 2321/021; H01L 23/34; H01L 23/345; H01L 23/36; F24H 9/1872; H05B 2203/02; H05B 1/02; H05B 2203/009; H05B 3/02; F24F 1/0007; F24F 11/0012; F24F 11/0076; F24F 11/04; F24F 11/053; F24F 13/20; F24F 2221/54; F24F 3/0442; F24F 3/0444; F24F 5/0042; F24F 7/007; G05D 23/19; G05D 23/1902; G05D 23/1917; G05D 23/1927; G05D 23/24; G05D 23/2412; G05D 23/30; H05K 7/20; H05K 1/0201

USPC ..... 392/465, 466

See application file for complete search history.

(56) References Cited

U.S. PATENT DOCUMENTS

| | | | | | |
|---|---|---|---|---|---|
| 3,384,801 | A | * | 5/1968 | Rodgers | 318/806 |
| 4,285,210 | A | * | 8/1981 | McCarty | 62/325 |
| 4,346,755 | A | * | 8/1982 | Alley et al. | 165/231 |
| 4,407,139 | A | * | 10/1983 | Ide et al. | 62/215 |

(Continued)

FOREIGN PATENT DOCUMENTS

| | | | |
|---|---|---|---|
| JP | 3-84350 | A | 4/1991 |
| JP | 4-240337 | A | 8/1992 |

(Continued)

OTHER PUBLICATIONS

JP 2003059623 A Machine Translation.*

(Continued)

*Primary Examiner* — Eric Stapleton

(74) *Attorney, Agent, or Firm* — Birch, Stewart, Kolasch & Birch, LLP

(57) ABSTRACT

Provided is an air conditioner including: a heater control section (54) for carrying out duty control on a positive temperature coefficient (PTC) heater (55); and a current detecting section (53) for detecting a current value of the PTC heater (55). The PTC heater (55) starts to be driven at a predetermined duty ratio. When the current value detected by the current detecting section (53) takes a peak (P), a duty ratio increasing process of increasing the duty ratio of the PTC heater (55) by a predetermined amount is repeated until the duty ratio reaches to 100%.

6 Claims, 9 Drawing Sheets

(56) References Cited

U.S. PATENT DOCUMENTS

| | | | | | |
|---|---|---|---|---|---|
| 4,439,995 | A * | 4/1984 | McCarty | 62/156 |
| 4,459,519 | A * | 7/1984 | Erdman | 318/400.08 |
| 4,534,179 | A * | 8/1985 | Stocking et al. | 62/128 |
| 4,622,827 | A * | 11/1986 | Jabami et al. | 62/158 |
| 4,732,009 | A * | 3/1988 | Frohbieter | 62/89 |
| 4,744,223 | A * | 5/1988 | Umezu | 62/176.5 |
| 5,074,120 | A * | 12/1991 | Kitamoto | 62/156 |
| 5,228,300 | A * | 7/1993 | Shim | 62/80 |
| 5,255,530 | A * | 10/1993 | Janke | 62/180 |
| 5,259,211 | A * | 11/1993 | Ikeda | 62/228.4 |
| 5,269,152 | A * | 12/1993 | Park | 62/89 |
| 5,295,363 | A * | 3/1994 | Oomura et al. | 62/227 |
| 5,323,619 | A * | 6/1994 | Kim | 62/160 |
| 5,491,323 | A * | 2/1996 | Mori et al. | 219/710 |
| 5,592,647 | A * | 1/1997 | Yamauchi et al. | 392/432 |
| 5,673,568 | A * | 10/1997 | Isshiki | 62/228.4 |
| 5,799,496 | A * | 9/1998 | Park et al. | 62/89 |
| 6,006,530 | A * | 12/1999 | Lee et al. | 62/187 |
| 6,134,901 | A * | 10/2000 | Harvest et al. | 62/228.4 |
| 6,192,700 | B1 * | 2/2001 | Runk et al. | 62/228.5 |
| 6,393,850 | B1 * | 5/2002 | Vanderstraeten | 62/196.3 |
| 6,513,341 | B2 * | 2/2003 | Nakajima | 62/228.4 |
| 6,817,198 | B2 * | 11/2004 | Wilson et al. | 62/228.3 |
| 7,036,329 | B2 * | 5/2006 | Ahmed et al. | 62/133 |
| 7,340,910 | B2 * | 3/2008 | Thompson | 62/186 |
| 7,458,227 | B2 * | 12/2008 | Lee et al. | 62/228.5 |
| 7,504,606 | B2 * | 3/2009 | Hamburger et al. | 219/543 |
| 7,513,123 | B2 * | 4/2009 | Lee et al. | 62/157 |
| 7,730,731 | B1 * | 6/2010 | Bash et al. | 62/198 |
| 7,739,882 | B2 * | 6/2010 | Evans et al. | 62/228.4 |
| 8,309,894 | B2 * | 11/2012 | Zimmer et al. | 219/552 |
| 2008/0124060 | A1 * | 5/2008 | Gao | 392/365 |
| 2011/0123180 | A1 * | 5/2011 | Kakiuchi | 392/465 |
| 2011/0123181 | A1 * | 5/2011 | Ariga | 392/466 |
| 2011/0198340 | A1 * | 8/2011 | Zimmer et al. | 219/494 |
| 2011/0303755 | A1 * | 12/2011 | Ariga | 237/2 A |

FOREIGN PATENT DOCUMENTS

| | | | |
|---|---|---|---|
| JP | 8-152179 | A | 6/1996 |
| JP | 1 055 885 | A2 | 11/2000 |
| JP | 1275698 | A | 12/2000 |
| JP | 2003-59623 | A | 2/2003 |

OTHER PUBLICATIONS

JP 08152179 A Machine Translation.*
JP 2003059623 A Machine Translation, 2003.*
JP 08152179 A Machine Translation, 1996.*

* cited by examiner

AIR CONDITIONER HAVING POSITIVE TEMPERATURE COEFFICIENT HEATER

This application is based on Japanese Patent Application No. 2009-268882 filed on Nov. 26, 2009, the contents of which are hereby incorporated by reference.

BACKGROUND OF THE INVENTION

1. Field of the Invention

The present invention relates to a control method for a positive temperature coefficient (PTC) heater and to an air conditioner including the PTC heater.

2. Description of Related Art

A conventional air conditioner is disclosed in Japanese Patent Application Laid-open No. Hei 08-152179. The air conditioner has an integrated structure in which an indoor unit to be placed indoors is disposed in the front and an outdoor unit to be placed outdoors is disposed in the rear. In the outdoor unit, there are disposed a compressor for operating the refrigeration cycle and an outdoor heat exchanger connected to the compressor. The indoor unit has an inlet and an outlet opened therein and, inside the indoor unit, there are disposed an indoor heat exchanger connected to the compressor via a refrigerant pipe, and a heating portion including a PTC heater.

When starting cooling operation, the refrigeration cycle is operated by the drive of the compressor, and the indoor heat exchanger serves as an evaporator on the low temperature side in the refrigeration cycle while the outdoor heat exchanger serves as a condenser on the high temperature side in the refrigeration cycle. The air in a room flows into the indoor unit from the inlet to be subjected to heat exchange with the indoor heat exchanger so that the air thus cooled is delivered to the room from the outlet. This way, cooling in the room is performed.

When starting heating operation, the refrigeration cycle is operated by the drive of the compressor, and the indoor heat exchanger serves as a condenser on the high temperature side in the refrigeration cycle while the outdoor heat exchanger serves as an evaporator on the low temperature side in the refrigeration cycle. The air in a room flows into the indoor unit from the inlet to be subjected to heat exchange with the indoor heat exchanger and is thereby heated. The air flowing into the indoor unit is further heated by the drive of the heating portion. The air thus heated is delivered to the room from the outlet, to thereby perform heating in the room.

The PTC heater of the heating portion is formed such that a heating element having PTC characteristics is sandwiched by electrodes, and is driven through application of a voltage between the electrodes. When the temperature of the heating element exceeds the Curie point, the heating element shows a sudden increase in resistance to reduce a current value and a heating amount thereof. Accordingly, a stable amount of heating in the heating portion is obtained to make it easy to generate warm air of a predetermined temperature and also prevent overheating.

In this case, the PTC heater is low in temperature when starting up and accordingly the heating element is low in resistance, which leads to a risk that an overcurrent flows to exceed power capacity. It is known to contain a component having negative temperature coefficient (NTC) characteristics in the heating element in order to suppress the overcurrent at the time of start-up. However, the component having the PTC characteristics and the component having the NTC characteristics have different coefficients of thermal expansion, which accelerates the characteristic deterioration in the PTC heater.

As a countermeasure, Japanese Patent Application Laid-open No. 2003-59623 discloses a control method in which a current flowing through the PTC heater at the time of start-up is monitored to control the drive of the PTC heater so that the power capacity is not exceeded. Specifically, the PTC heater is subjected to triac control, in which duty control of varying a pulse width of a gate signal to a triac is carried out.

The PTC heater starts to be driven with the pulse width of the gate signal set to 0, and thereafter, the pulse width is increased by 1 bit at a time. Then, when a current value of the PTC heater reaches a predetermined allowable range, increasing the pulse width is stopped, and when the current value exceeds the allowable range, the pulse width of the gate signal is decreased. On the other hand, when the current value falls below the allowable range, the pulse width is increased. This way, the current flowing through the PTC heater makes a transition within the allowable range, to thereby prevent the overcurrent at the time of start-up.

However, in the above-mentioned drive control on the PTC heater disclosed in Japanese Patent Application Laid-open No. 2003-59623, the PTC heater has a significantly low initial temperature in some cases depending on ambient temperature or an air flow rate. In such a case, if the pulse width of the gate signal to the triac is increased at an advanced timing, an overcurrent flows through the PTC heater, causing a problem that the power capacity is exceeded and the circuit breaker trips.

SUMMARY OF THE INVENTION

The present invention has an object of providing a control method for a positive temperature coefficient (PTC) heater, with which an overcurrent at the time of start-up is reliably prevented. Further, the present invention has another object of providing an air conditioner including a PTC heater, which is capable of reliably preventing an overcurrent at the time of start-up.

In order to achieve the above-mentioned object, according to the present invention, there is provided an air conditioner including: a positive temperature coefficient (PTC) heater; a heater control section for carrying out duty control on the PTC heater; and a current detecting section for detecting a current value of the PTC heater, the air conditioner delivering air heated by the PTC heater to a room, to thereby perform heating operation, in which the PTC heater starts to be driven at a predetermined duty ratio, and a duty ratio increasing process of increasing the duty ratio by a predetermined amount every time the current value detected by the current detecting section takes a peak is repeated until the duty ratio reaches to 100%.

According to this configuration, when starting the heating operation, the heater control section applies a drive voltage to the PTC heater at a duty ratio of, for example, 50%. The current detecting section monitors the current value of the PTC heater, and when the current value of the PTC heater takes a peak, the heater control section increases the duty ratio by, for example, 10%. This process is repeated to gradually increase the duty ratio so that the PTC heater is driven at a duty ratio of 100%. Consequently, the air thus heated by the PTC heater is delivered to the room.

Further, according to the present invention, in the air conditioner having the above-mentioned configuration, it is preferred that the duty ratio increasing process be carried out when the current value detected by the current detecting section is smaller than a first predetermined value, whereas, when the current value detected by the current detecting section is larger than a second predetermined value, a duty ratio decreasing process of decreasing the duty ratio of the PTC heater by a predetermined amount be carried out.

According to this configuration, in a case where the current value detected by the current detecting section is smaller than a first predetermined threshold, when the current value takes a peak, the duty ratio increasing process is carried out to increase the duty ratio of the PTC heater by, for example, 10%. When the current value detected by the current detecting section becomes larger than a second predetermined threshold, the duty ratio decreasing process is carried out to decrease the duty ratio of the PTC heater by, for example, 10%. This way, an overcurrent of the PTC heater is prevented. The first threshold for switching to the duty ratio increasing process may be lower than or the same as the second threshold for switching to the duty ratio decreasing process. Further, the increment of the duty ratio by the duty ratio increasing process and the decrement of the duty ratio by the duty ratio decreasing process may be different.

Further, according to the present invention, it is preferred that the air conditioner having the above-mentioned configuration further include an air blower for generating air flow toward the PTC heater, that the air blower be driven at a first rotation speed when the PTC heater starts to be driven, and that the air blower be driven at a second rotation speed higher than the first rotation speed when the duty ratio of the PTC heater reaches to 100%.

According to this configuration, when the PTC heater starts to be driven, the air blower is rotated at the first rotation speed, which is a low speed, to thereby accelerate heating of the PTC heater. When the duty ratio of the PTC heater has reached to 100%, the air blower is rotated at the second rotation speed, which is a high speed, to thereby accelerate heat exchange between the PTC heater and the air.

Further, according to the present invention, in the air conditioner having the above-mentioned configuration, it is preferred that the air blower be reduced in rotation speed gradually from the first rotation speed until the duty ratio of the PTC heater reaches to 100%. According to this configuration, when the PTC heater starts to be driven, the air blower is rotated at the first rotation speed and gradually reduced in rotation speed to be rotated at a low speed. This way, the degree of accelerating the heat exchange of the PTC heater is weakened to suppress a thermal impact on the heating element. Then, when the duty ratio of the PTC heater has reached to 100%, the air blower is rotated at the second rotation speed, which is a high speed.

Further, according to the present invention, in the air conditioner having the above-mentioned configuration, it is preferred that the current value detected by the current detecting section be acquired at predetermined intervals, and that it be determined that the peak has appeared when the current value takes one of the same value as a current value acquired last time and a value lower than the current value acquired last time.

Further, according to the present invention, in the air conditioner having the above-mentioned configuration, it is preferred that the heater control section carry out triac control on the PTC heater.

Further, according to the present invention, there is provided a control method for a PTC heater, including: a heater control section for carrying out duty control on the PTC heater; a current detecting section for detecting a current value of the PTC heater; starting driving the PTC heater at a predetermined duty ratio; and repeating a duty ratio increasing process of increasing the duty ratio by a predetermined amount every time the current value detected by the current detecting section takes a peak, until the duty ratio reaches to 100%.

Further, according to the present invention, it is preferred that the control method for a PTC heater further include: an air blower for generating air flow toward the PTC heater; driving the air blower at a first rotation speed when the PTC heater starts to be driven; and driving the air blower at a second rotation speed higher than the first rotation speed when the duty ratio of the PTC heater reaches to 100%.

According to the present invention, the PTC heater starts to be driven at a predetermined duty ratio, and the duty ratio increasing process of increasing the duty ratio by a predetermined amount every time the current value of the PTC heater takes a peak is repeated until the duty ratio reaches to 100%. Therefore, even if the PTC heater is low in temperature at the time of drive start, a timing of increasing the duty ratio is not advanced, to thereby reliably prevent an overcurrent of the PTC heater at the time of start-up.

DETAILED DESCRIPTION OF PREFERRED EMBODIMENTS

Figure 1:
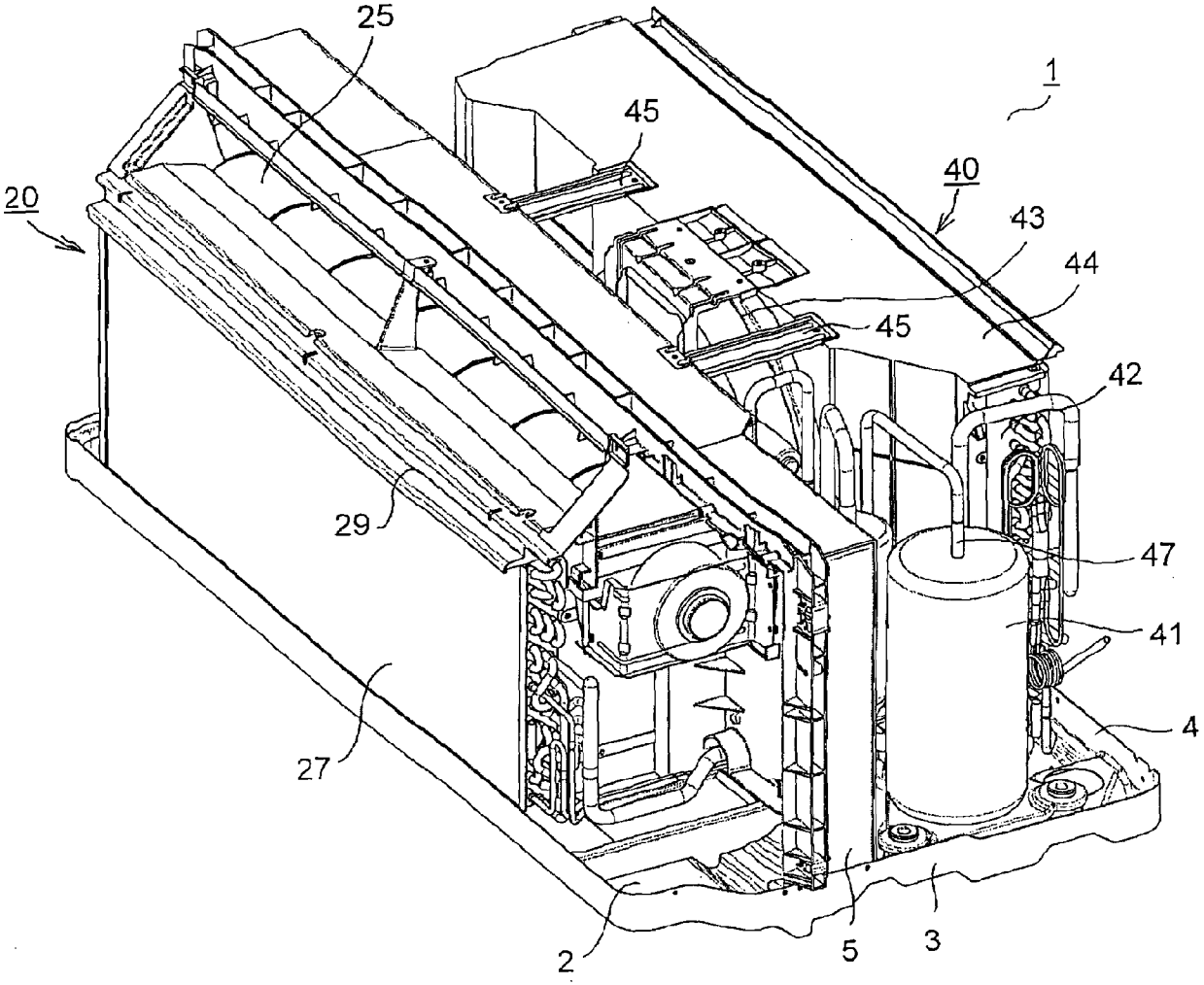
FIG. 1 is a perspective view illustrating an air conditioner according to a first embodiment of the present invention.
Figure 2:
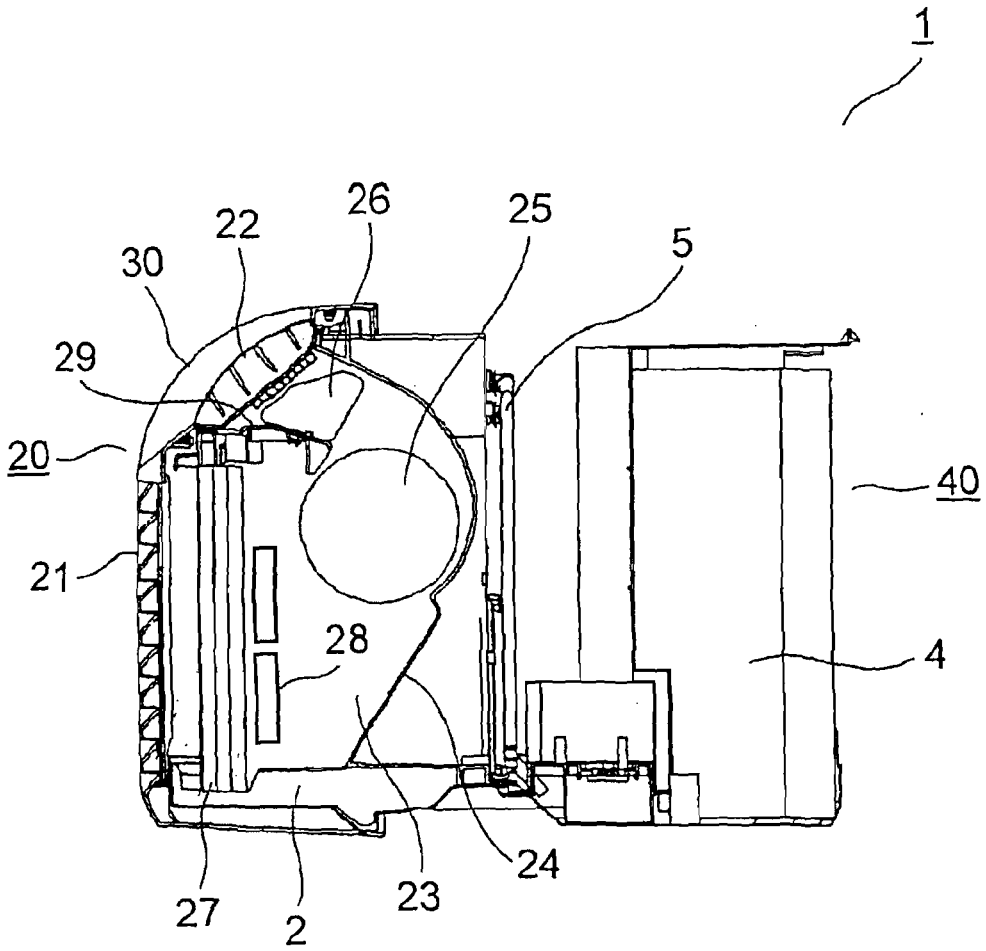
FIG. 2 is a side sectional view illustrating the air conditioner according to the first embodiment of the present invention.

Hereinafter, embodiments of the present invention are described with reference to the accompanying drawings. FIG. 1 and FIG. 2 are a perspective view and a side sectional view, respectively, illustrating an air conditioner 1 according to a first embodiment of the present invention. FIG. 1 illustrates a state where an outer cover 30 (see FIG. 2) is detached. The air conditioner 1 has an integrated structure including an indoor unit 2 which is to be placed indoors and an outside unit 4 which is to be placed outdoors contiguous to the indoor unit 2.

The indoor unit 2 is provided with an inlet 21 in the front, and the outside unit 4 is provided with an outdoor heat exchanger 42 in the front. In the following description, the inlet 21 side is referred to as front side, and the outdoor heat exchanger 42 side is referred to as rear (back) side. Further, the right and left sides of the inlet 21 when facing forward are referred to as right and left sides of the air conditioner 1.

The indoor unit 2 and the outdoor unit 4 are installed on a bottom plate 3 and separated longitudinally by a partition wall 5. The indoor unit 2 forms a casing 20 delimited by the bottom plate 3, the partition wall 5, and the outer cover 30. Similarly, the outdoor unit 4 forms a casing 40 delimited by the bottom plate 3, the partition wall 5, and an outer cover (not shown).

In the outdoor unit 4, a compressor 41 for operating the refrigeration cycle is disposed at a right side end portion. On the back side of the outdoor unit 4, the outdoor heat exchanger 42 is disposed and connected to the compressor 41 via a refrigerant pipe 47. An outdoor fan 43 in the form of a propeller fan is disposed at a horizontal central portion so as to face the outdoor heat exchanger 42. The outdoor fan 43 and the outdoor heat exchanger 42 are disposed in a housing 44. The housing 44 forms a duct for guiding air flow from the outdoor fan 43 to the outdoor heat exchanger 42. The housing 44 is supported by the partition wall 5 via brackets 45.

The inlet 21 is opened in a front surface of the outer cover 30 covering the indoor unit 2, and an outlet 22 is opened therein above the inlet 21. Inside the indoor unit 2, the inlet 21 and the outlet 22 are coupled by a blower duct 24 to form a blower passage 23. The blower duct 24 includes a duct member 29 as its upper part, which is detachable when the outer cover 30 is detached. The duct member 29 constitutes the lower wall of the blower passage 23 in the vicinity of the outlet 22.

Inside the blower passage 23, an indoor fan 25 (air blower) in the form of a cross-flow fan is provided. In the vicinity of the outlet 22 inside the blower passage 23, a louver 26 for adjusting the direction of air flow is provided. Between the indoor fan 25 and the inlet 21, an indoor heat exchanger 27 is disposed and connected to the compressor 41 via the refrigerant pipe 47.

Between the indoor fan 25 and the indoor heat exchanger 27, a heating portion 28 including a plurality of positive temperature coefficient (PTC) heaters 55 (see FIG. 3) is disposed. The indoor fan 25 forms air flow which flows from the inlet 21 toward the heating portion 28 in the blower passage 23. The indoor heat exchanger 27 and the heating portion 28 are covered by the duct member 29 from above. When the duct member 29 is detached, the heating portion 28 is detachable.

Figure 3:
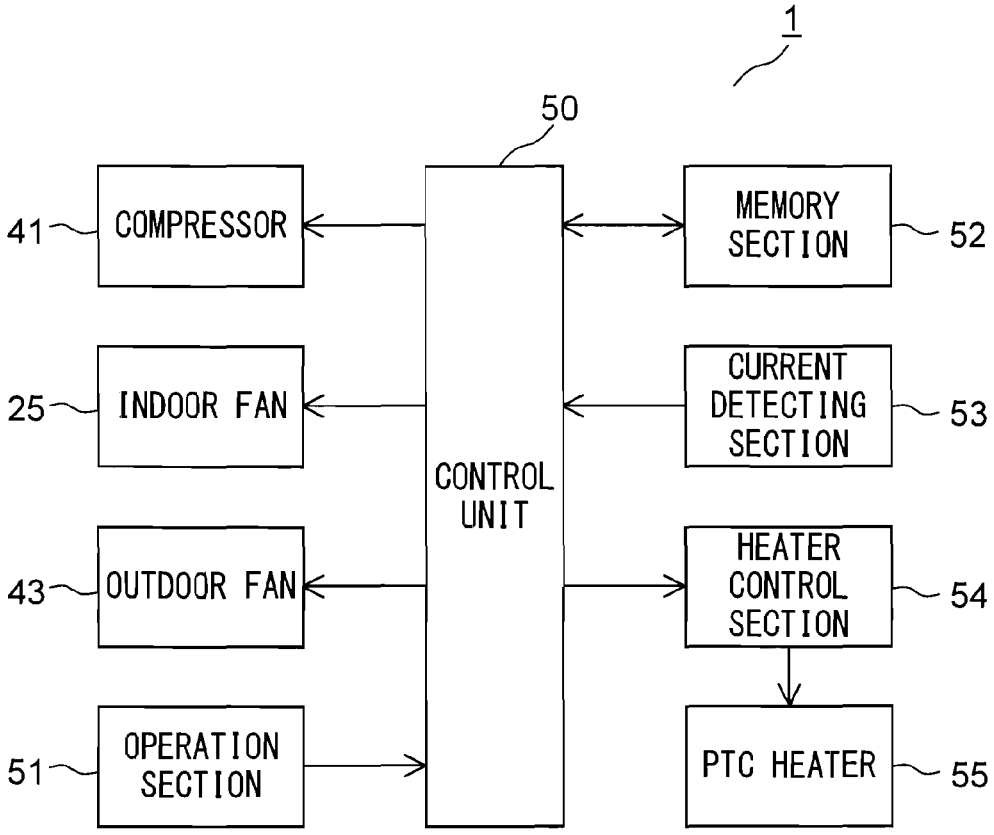
FIG. 3 is a block diagram illustrating a configuration of the air conditioner according to the first embodiment of the present invention.

FIG. 3 is a block diagram illustrating a configuration of the air conditioner 1. The air conditioner 1 includes a control unit 50 for controlling respective sections. The control unit 50 is connected to the compressor 41, the indoor fan 25, the outdoor fan 43, an operation section 51, a memory section 52, a current detecting section 53, and a heater control section 54. The heater control section 54 is connected to the PTC heaters 55 of the heating portion 28.

The operation section 51 is constituted by an operation button provided on the surface of the casing 20 or a remote control, and gives an operation instruction and inputs settings with respect to the air conditioner 1. The memory section 52 includes a read-only memory (ROM) and a random access memory (RAM). The memory section 52 stores operating programs, setting conditions, and the like of the air conditioner 1, and temporarily stores a calculation made by the control unit 50. Note that, the memory section 52 is connected externally to the control unit 50, but the memory section 52 may be provided inside the control unit 50.

The current detecting section 53 detects a value of a current flowing through the PTC heater 55. The heater control section 54 controls the drive of the PTC heater 55. The heater control section 54 includes a triac circuit or a relay circuit, and carries out duty control on the PTC heater 55. The heater control section 54 is desired to be formed of a triac circuit, because the triac circuit may reduce switching sound accompanying switching compared with the relay circuit. The PTC heater 55 is formed such that a heating element having PTC characteristics is sandwiched by electrodes, and generates heat through application of a drive voltage between the electrodes by the heater control section 54.

Figure 4:
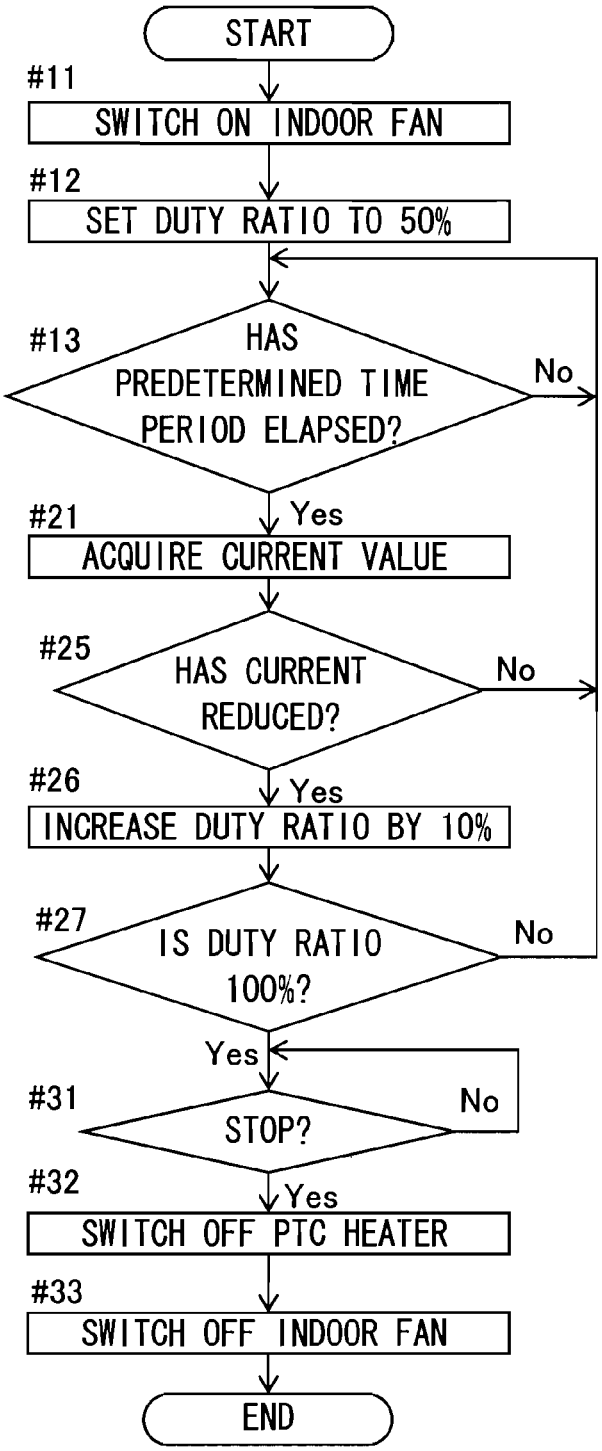
FIG. 4 is a flow chart illustrating a drive operation of a positive temperature coefficient (PTC) heater in the air conditioner according to the first embodiment of the present invention.
Figure 5:
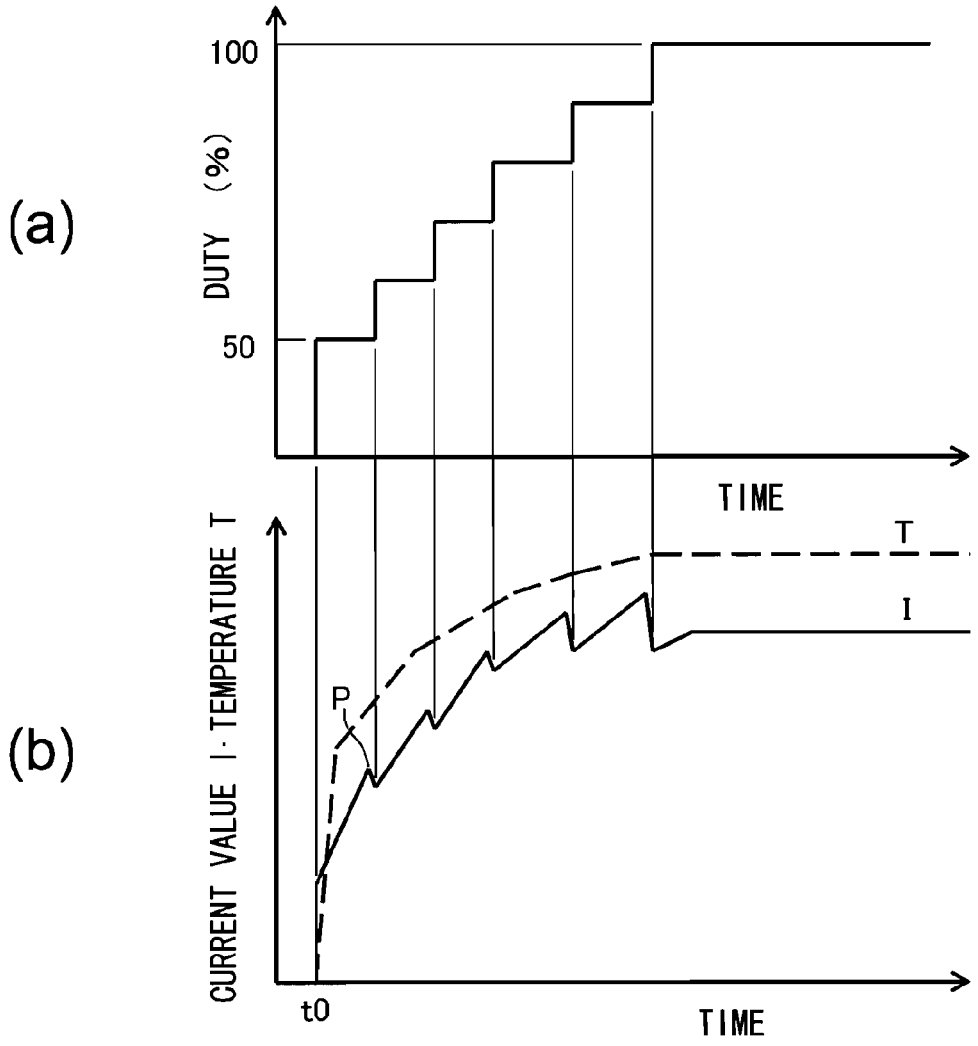
FIG. 5 is a time chart illustrating the drive operation of the PTC heater in the air conditioner according to the first embodiment of the present invention.

FIG. 4 is a flow chart illustrating an operation of drive control on the PTC heater 55 by the heater control section 54. FIG. 5 is a time chart illustrating the operation of the drive control on the PTC heater 55 by the heater control section 54. The part (a) of FIG. 5 shows a duty ratio (%) of the drive voltage of the PTC heater 55. The part (b) of FIG. 5 shows a current value detected by the current detecting section 53 (represented by I in the time chart) and a temperature of the PTC heater 55 (represented by T in the time chart).

In Step #11 of FIG. 4, the indoor fan 25 is driven at a predetermined rotation speed (for example, 1,140 RPM). In Step #12, the PTC heater 55 starts to be driven at a duty ratio of 50% (time t0). Then, the temperature of the PTC heater 55 is increased, and a current flowing through the PTC heater 55 increases until the temperature of the heating element reaches the Curie point.

Note that, the duty ratio at the start of drive is set such that the temperature of the heating element of the PTC heater 55 is increased up to a temperature slightly exceeding the Curie point, at which a resistance thereof starts to increase. Accordingly, the duty ratio to be set is different depending on the characteristics of the PTC heater 55 or an air flow rate.

The heater control section 54 acquires detection results of the current detecting section 53 at intervals of a predetermined time period, and in Step #13, stands by until the predetermined time period elapses. After the lapse of the predetermined time period, in Step #21, a current value detected by the current detecting section 53 is acquired. In Step #25, it is determined whether or not the current value acquired from the current detecting section 53 is lower than a current value acquired last time. When the current value acquired from the current detecting section 53 is not lower than a current value acquired last time, the processing returns to Step #13 and repeats Steps #13 to #25.

When the temperature of the PTC heater 55 is increased and the temperature of the heating element exceeds the Curie point, the heating element increases in resistance so that the current value of the PTC heater 55 takes a peak P (see part (b) of FIG. 5). Accordingly, when the current value acquired from the current detecting section 53 is lower than a current value acquired last time, it is determined that the peak P has appeared, and the processing proceeds to Step #26.

In Step #26, a duty ratio increasing process is carried out to increase the duty ratio of the PTC heater 55 by 10% (representing 10% with respect to 100%). This way, the PTC heater 55 is driven at a duty ratio of 60%. The increase in duty ratio allows the current value of the PTC heater 55 to increase again. Note that, the increment of the duty ratio may be other than 10%.

In Step #27, it is determined whether or not the duty ratio of the PTC heater 55 has reached to 100%. When the duty ratio of the PTC heater 55 has not reached to 100%, the processing returns to Step #13 and repeats Steps #13 to #27. Then, similarly to the above description, the temperature of the PTC heater 55 is increased, and the heating element increases in resistance so that the current value of the PTC heater 55 takes a peak P. This way, the duty ratio of the PTC heater 55 is increased by 10% at a time by the duty ratio increasing process in Step #26, to thereby increase the current value gradually.

When the duty ratio of the PTC heater 55 has reached to 100%, the processing proceeds to Step #31, in which the drive of the PTC heater 55 is continued until the operation section 51 gives a stop instruction. When receiving the stop instruction, the PTC heater 55 is stopped in Step #32, and in Step #33, the indoor fan 25 is stopped, ending the processing.

In the air conditioner 1 having the above-mentioned configuration, when starting cooling operation, the refrigeration cycle is operated by the drive of the compressor 41. Then, the indoor heat exchanger 27 serves as an evaporator on the low temperature side in the refrigeration cycle while the outdoor heat exchanger 42 serves as a condenser on the high temperature side in the refrigeration cycle. The outdoor heat exchanger 42 is cooled by the outdoor fan 43 to dissipate heat. By the drive of the indoor fan 25, the air in a room flows into the blower passage 23 from the inlet 21 to be subjected to heat exchange with the indoor heat exchanger 27 so that the air thus cooled is delivered to the room from the outlet 22. This way, cooling in the room is performed.

When starting heating operation, the refrigeration cycle is operated by the drive of the compressor 41. Then, the indoor heat exchanger 27 serves as a condenser on the high temperature side in the refrigeration cycle while the outdoor heat exchanger 42 serves as an evaporator on the low temperature side in the refrigeration cycle. The outdoor heat exchanger 42 is heated by the outdoor fan 43. By the drive of the indoor fan 25, the air in a room flows into the blower passage 23 from the inlet 21 to be subjected to heat exchange with the indoor heat exchanger 27 and is thereby heated.

Further, when the heating portion 28 is driven, the PTC heater 55 is subjected to drive control with the above-mentioned control method, and the air in the blower passage 23 is further heated by the PTC heater 55. The air thus heated by the indoor heat exchanger 27 and the heating portion 28 is delivered to the room from the outlet 22, to thereby perform heating in the room. During the heating operation, only the heating portion 28 may be used to heat the air, while stopping the compressor 41.

According to the first embodiment, the PTC heater 55 starts to be driven at a predetermined duty ratio, and the duty ratio increasing process (Step #26) of increasing the duty ratio by a predetermined amount every time the current value of the PTC heater 55 takes a peak P is repeated until the duty ratio reaches to 100%. Therefore, even if the PTC heater 55 is low in temperature at the time of drive start, a timing of increasing the duty ratio is not advanced, to thereby reliably prevent an overcurrent of the PTC heater 55 at the time of start-up.

Further, the heater control section 54 acquires the current value of the PTC heater 55 detected from the current detecting section 53 at predetermined intervals and, when the current value is reduced compared with a current value acquired last time, determines that the peak P has appeared. Therefore, the peak P of the current value may be detected with ease. Note that, the determination that the peak P has appeared may be made when the current value acquired from the current detecting section 53 takes the same value as a current value acquired last time.

Figure 6:
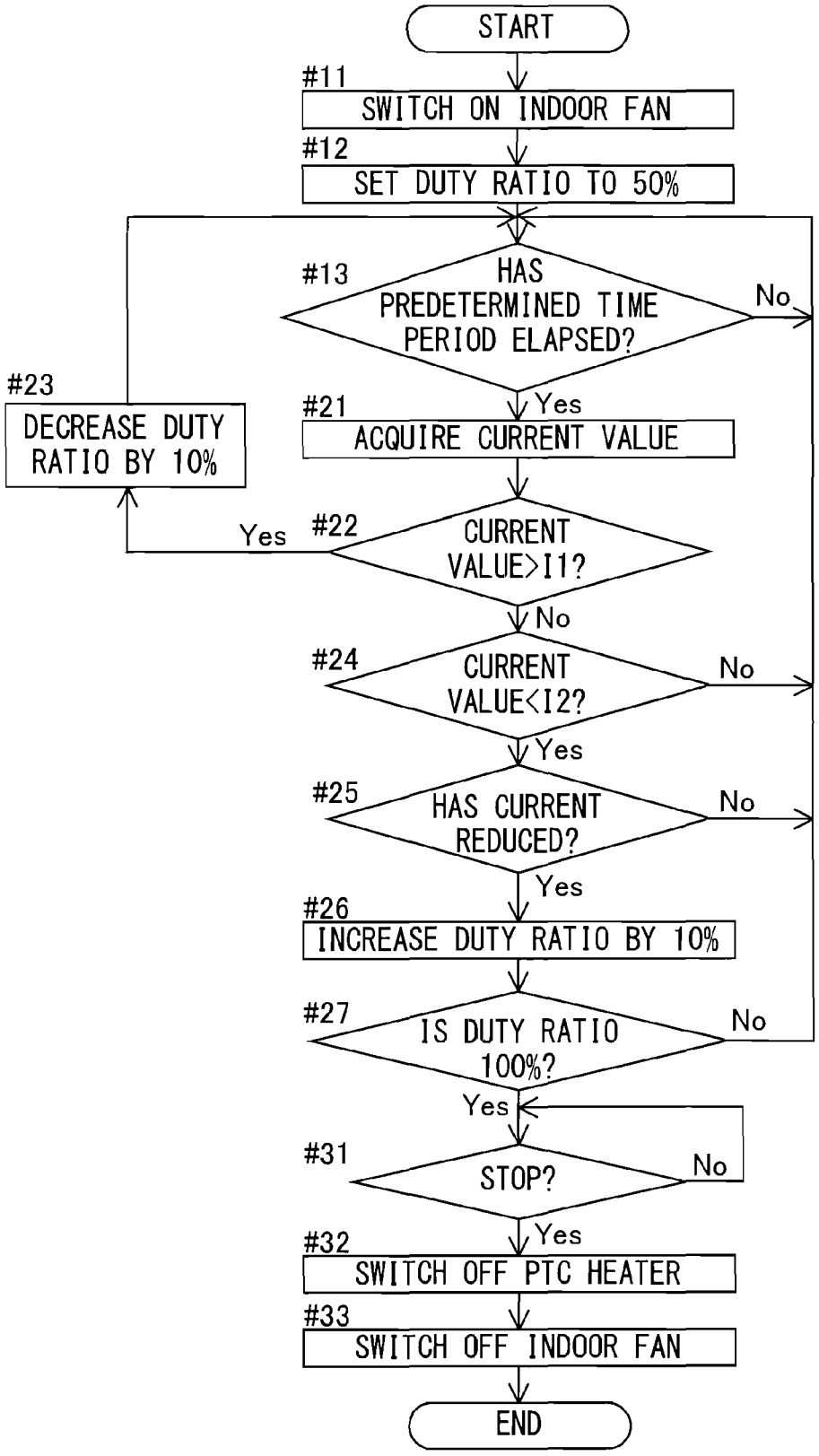
FIG. 6 is a flow chart illustrating a drive operation of a PTC heater in an air conditioner according to a second embodiment of the present invention.

Next, FIG. 6 is a flow chart illustrating an operation of drive control on a PTC heater 55 by a heater control section 54 in an air conditioner 1 according to a second embodiment of the present invention. In the second embodiment, the processing of Steps #22 to #24 is added to the above-mentioned operation according to the first embodiment illustrated in FIG. 4. The rest of the operation is the same as that of the first embodiment, and hence the description thereof is omitted.

In Step #21, a current value of the PTC heater 55 detected by the current detecting section 53 is acquired, and the processing proceeds to Step #22. In Step #22, it is determined whether or not the current value acquired from the current detecting section 53 is larger than a predetermined current value I1. The current value I1 is set based on power capacity. Over the current value I1, the PTC heater 55 enters an overcurrent state where a high current may flow through the PTC heater 55 to exceed the power capacity.

For that reason, when the current value acquired from the current detecting section 53 is larger than the current value I1, in Step #23, a duty ratio decreasing process is carried out to decrease the duty ratio of the PTC heater 55 by 10%. This allows the PTC heater 55 to recover from the overcurrent state, and the processing returns to Step #13.

When the current value acquired from the current detecting section 53 is not larger than the current value I1, it is determined in Step #24 whether or not the current value is smaller than a predetermined current value I2. The current value I2 is set to be lower than the current value I1. When the current value acquired from the current detecting section 53 is smaller than the current value I2, the processing proceeds to Step #25, and after the detection of a peak P, the duty ratio increasing process is carried out in Step #26.

When the current value acquired from the current detecting section 53 is not smaller than the current value I2, the processing returns to Step #13. In other words, irrespective of the appearance of the peak P, the duty ratio of the PTC heater 55 is maintained. Accordingly, the duty ratio is not varied between the current value I1 and the current value I2, to thereby prevent in advance the PTC heater 55 from entering the overcurrent state.

According to the second embodiment, the same effects as those of the first embodiment can be obtained. Besides, when the current value acquired from the current detecting section 53 is larger than the current value I1, the duty ratio decreasing process is carried out in Step #23, to thereby allow the PTC heater 55 to recover from the overcurrent state and more reliably prevent the current value thereof from exceeding the power capacity.

Further, in the case where the current value acquired from the current detecting section 53 falls between the current value I1 and the current value I2, the duty ratio increasing process in Step #26 is not carried out. Therefore, the PTC heater 55 is prevented in advance from entering the overcurrent state.

Note that, Step #24 may be omitted by using the same value for the current value I1 and the current value I2. Further, the increment of the duty ratio by the duty ratio increasing process in Step #26 and the decrement of the duty ratio by the duty ratio decreasing process in Step #23 may be different.

Figure 7:
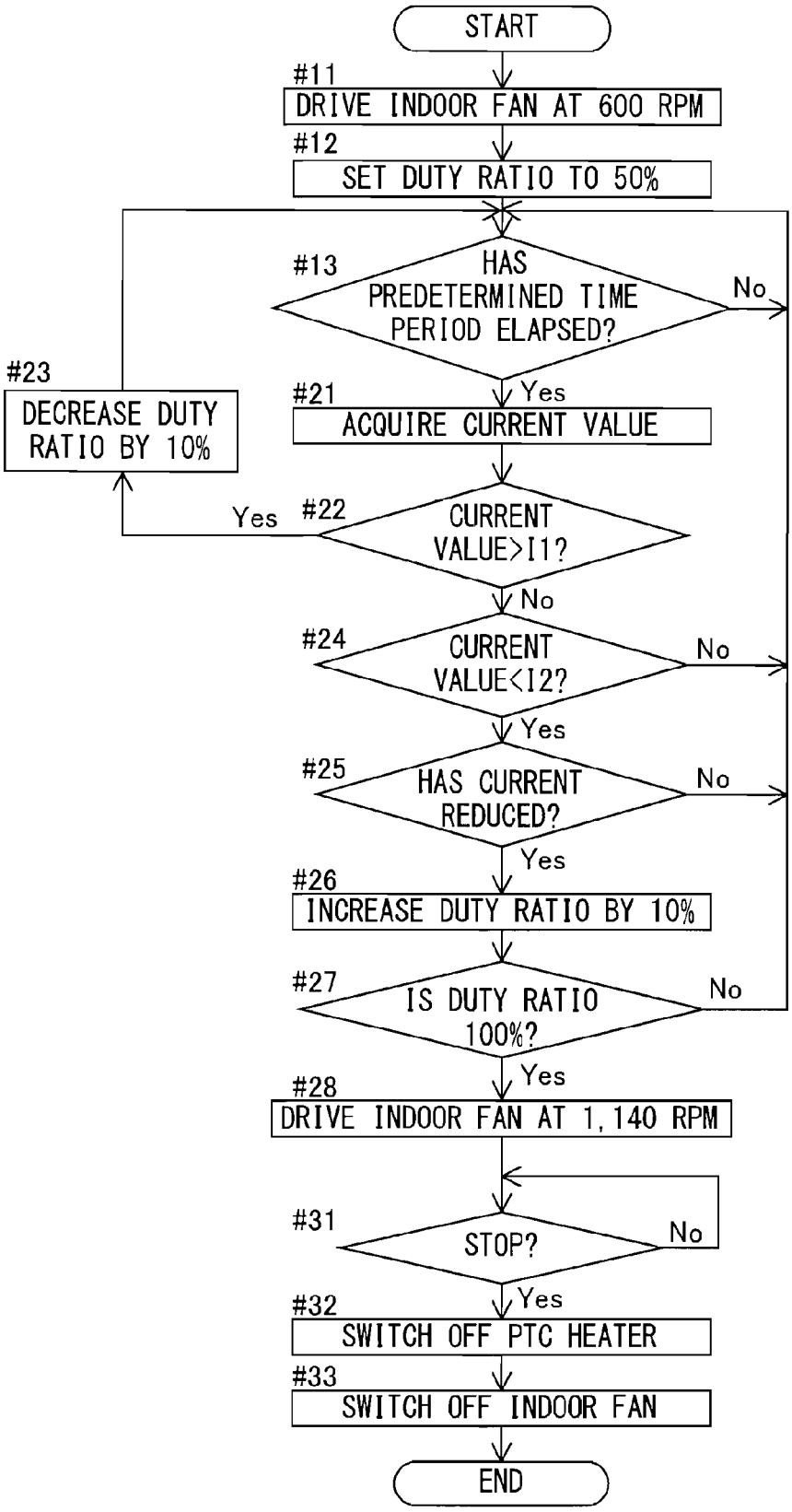
FIG. 7 is a flow chart illustrating a drive operation of a PTC heater in an air conditioner according to a third embodiment of the present invention.

Next, FIG. 7 is a flow chart illustrating an operation of drive control on a PTC heater 55 by a heater control section 54 in an air conditioner 1 according to a third embodiment of the present invention. In the third embodiment, compared with the above-mentioned operation according to the second embodiment illustrated in FIG. 6, Step #11 is a different operation and the processing of Step #28 is added. The rest of the operation is the same as that of the second embodiment, and hence the description thereof is omitted.

In Step #11, the indoor fan 25 is driven at a first rotation speed (for example, 600 RPM), and in Step #12, the PTC heater 55 is driven at a duty ratio of 50%. Then, when the duty ratio of the PTC heater 55 has reached to 100%, in Step #28, the indoor fan 25 is driven at a second rotation speed (for example, 1,140 RPM) higher than the first rotation speed.

Therefore, the same effects as those of the second embodiment can be obtained and further an air flow rate of the indoor fan 25 is reduced at the time of start-up so as to accelerate heat exchange between the PTC heater 55 and the air. Consequently, the temperature of the PTC heater 55 may be increased quickly.

Further, when installing the air conditioner 1, the number of the plurality of PTC heaters 55 to be connected is determined so that a current value at a duty ratio of 100% falls below the power capacity. The heating element of the PTC heater 55 often has such characteristics that a current value thereof becomes maximum at a duty ratio of 70% to 80%, rather than 100%. Accordingly, there is a danger that the power capacity may be exceeded at a duty ratio of 70% to 80%. However, by reducing the air flow rate of the indoor fan 25 as compared with that at a duty ratio of 100%, the temperature of the PTC heater 55 may be rapidly increased to reduce the current value.

Figure 8:
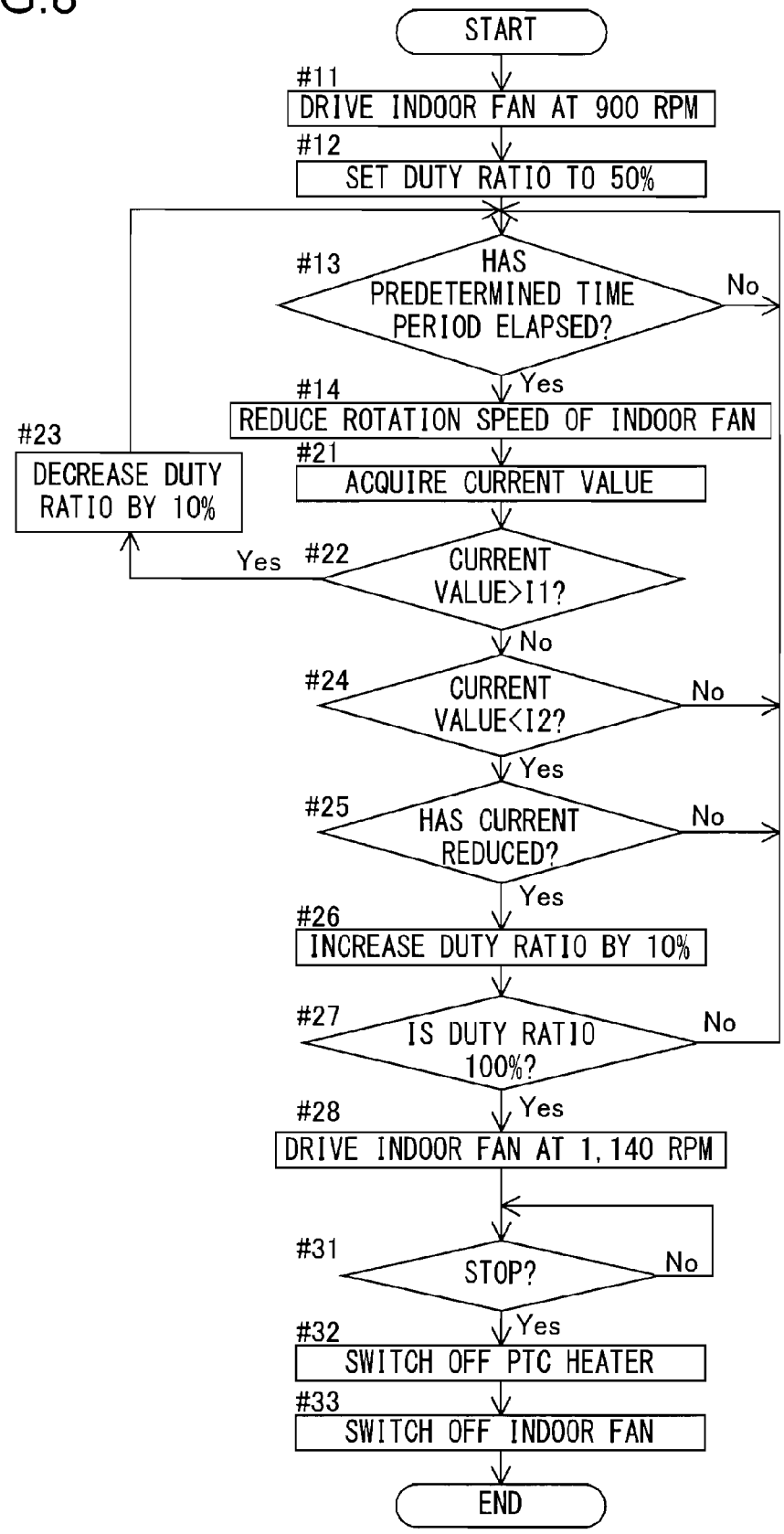
FIG. 8 is a flow chart illustrating a drive operation of a PTC heater in an air conditioner according to a fourth embodiment of the present invention.
Figure 9:
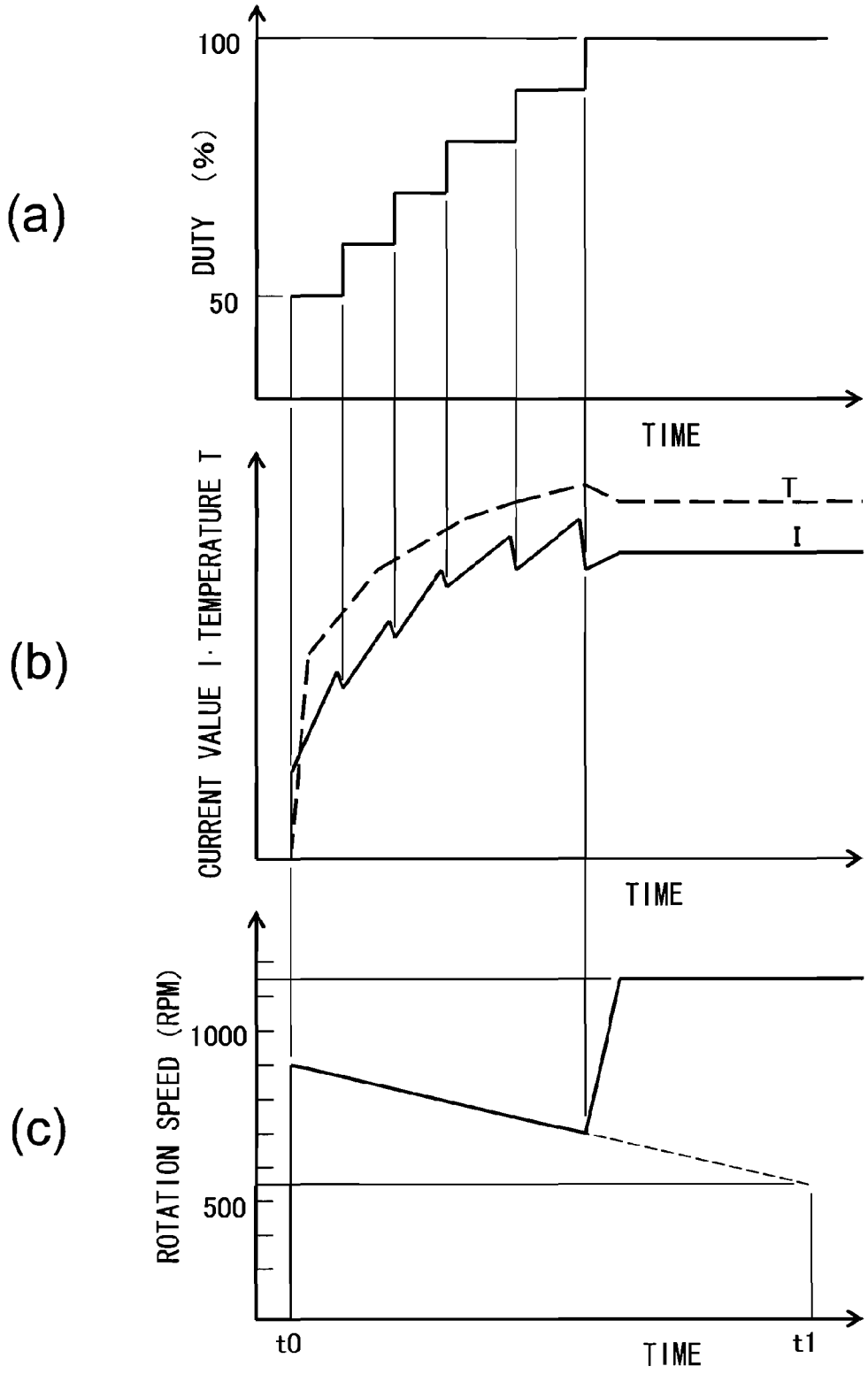
FIG. 9 is a time chart illustrating the drive operation of the PTC heater in the air conditioner according to the fourth embodiment of the present invention.

Next, FIG. 8 and FIG. 9 are a flow chart and a time chart, respectively, illustrating an operation of drive control on a PTC heater 55 by a heater control section 54 in an air conditioner 1 according to a fourth embodiment of the present invention. In the fourth embodiment, compared with the above-mentioned operation according to the third embodiment illustrated in FIG. 7, Step #11 is a different operation and the processing of Step #14 is added. The rest of the operation is the same as that of the third embodiment, and hence the description thereof is omitted.

The part (a) of FIG. 9 shows a duty ratio (%) of the drive voltage of the PTC heater 55. The part (b) of FIG. 9 shows a current value detected by the current detecting section 53 (represented by I in the time chart) and a temperature of the PTC heater 55 (represented by T in the time chart). The part (c) of FIG. 9 shows a rotation speed (RPM) of the indoor fan 25.

In Step #11, the indoor fan 25 is driven at a first rotation speed (for example, 900 RPM), and in Step #12, the PTC heater 55 is driven at a duty ratio of 50%. After the lapse of an interval for acquiring a current value from the current detecting section 53 in Step #13, the rotation speed of the indoor fan 25 is reduced by a predetermined amount in Step #14. This way, the rotation speed of the indoor fan 25 is gradually reduced. In the fourth embodiment, the rotation speed of the indoor fan 25 is reduced at a reduction rate allowing the rotation speed to be reduced from 900 RPM to 550 RPM after the lapse of a time t1 (for example, 10 minutes).

When the duty ratio of the PTC heater 55 has reached to 100%, in Step #28, the indoor fan 25 is driven at a second rotation speed (for example, 1,140 RPM) higher than the first rotation speed. At this time, an amount of cooling in the PTC heater 55 is increased, and hence the temperature T of the PTC heater 55 is reduced a little (the same is applied to the above-mentioned third embodiment).

According to the fourth embodiment, the same effects as those of the first to third embodiments can be obtained. Besides, as compared with the third embodiment, the degree of accelerating the heat exchange of the PTC heater 55 may be weakened. This suppresses a thermal impact on the heating element and also suppresses occurrence of cracks or the like. Therefore, the temperature of the PTC heater 55 may be quickly increased while preventing the life of the PTC heater 55 from being short.

The present invention is applicable to an air conditioner, a heating appliance, or the like including a PTC heater.

FIG. 3

25 INDOOR FAN
41 COMPRESSOR
43 OUTDOOR FAN
50 CONTROL UNIT
51 OPERATION SECTION
52 MEMORY SECTION
53 CURRENT DETECTING SECTION
54 HEATER CONTROL SECTION
55 PTC HEATER

FIG. 4
#11 SWITCH ON INDOOR FAN
#12 SET DUTY RATIO TO 50%
#13 HAS PREDETERMINED TIME PERIOD ELAPSED?
#21 ACQUIRE CURRENT VALUE
#25 HAS CURRENT REDUCED?
#26 INCREASE DUTY RATIO BY 10%
#27 IS DUTY RATIO 100%?
#31 STOP?
#32 SWITCH OFF PTC HEATER
#33 SWITCH OFF INDOOR FAN
(1) START
(2) END

FIG. 5
(1) TIME
(2) CURRENT VALUE I·TEMPERATURE T

FIG. 6
#11 SWITCH ON INDOOR FAN
#12 SET DUTY RATIO TO 50%
#13 HAS PREDETERMINED TIME PERIOD ELAPSED?
#21 ACQUIRE CURRENT VALUE
#22 CURRENT VALUE>11?
#23 DECREASE DUTY RATIO BY 10%
#24 CURRENT VALUE<12?
#25 HAS CURRENT REDUCED?
#26 INCREASE DUTY RATIO BY 10%
#27 IS DUTY RATIO 100%?
#31 STOP?
#32 SWITCH OFF PTC HEATER
#33 SWITCH OFF INDOOR FAN
(1) START
(2) END

FIG. 7
#11 DRIVE INDOOR FAN AT 600 RPM
#12 SET DUTY RATIO TO 50%
#13 HAS PREDETERMINED TIME PERIOD ELAPSED?
#21 ACQUIRE CURRENT VALUE
#22 CURRENT VALUE>11?
#23 DECREASE DUTY RATIO BY 10%
#24 CURRENT VALUE<12?
#25 HAS CURRENT REDUCED?
#26 INCREASE DUTY RATIO BY 10%
#27 IS DUTY RATIO 100%?
#28 DRIVE INDOOR FAN AT 1,140 RPM
#31 STOP?
#32 SWITCH OFF PTC HEATER
#33 SWITCH OFF INDOOR FAN
(1) START
(2) END

FIG. 8
#11 DRIVE INDOOR FAN AT 900 RPM
#12 SET DUTY RATIO TO 50%
#13 HAS PREDETERMINED TIME PERIOD ELAPSED?
#14 REDUCE ROTATION SPEED OF INDOOR FAN
#21 ACQUIRE CURRENT VALUE
#22 CURRENT VALUE>I1?
#23 DECREASE DUTY RATIO BY 10%
#24 CURRENT VALUE<I2?

#25 HAS CURRENT REDUCED?
#26 INCREASE DUTY RATIO BY 10%
#27 IS DUTY RATIO 100%?
#28 DRIVE INDOOR FAN AT 1,140 RPM
#31 STOP?
#32 SWITCH OFF PTC HEATER
#33 SWITCH OFF INDOOR FAN
(1) START
(2) END
FIG. 9
(1) TIME
(2) CURRENT VALUE I·TEMPERATURE T
(3) ROTATION SPEED

What is claimed is:

1. An air conditioner, comprising:
an indoor unit having an inlet and an outlet;
an indoor heat exchanger arranged in the indoor unit;
a blower duct connecting between the inlet and the outlet inside the indoor unit and forming a blower passage;
a blower fan arranged in the blower passage;
an outdoor unit having a housing;
an outdoor heat exchanger arranged in the housing;
an outdoor fan arranged in the housing;
a compressor connected to the indoor and outdoor heat exchangers via refrigerant pipe;
a power supply section;
a positive temperature coefficient (PTC) heater which starts to be driven at a predetermined duty ratio;
a heater control circuit for carrying out duty control on the PTC heater; and
the air conditioner delivering air heated by the PTC heater to a room, to thereby perform heating operation,
wherein the heater control circuit is configured to:
acquire, at predetermined intervals, a current value of the PTC heater that has started being driven at the predetermined duty ratio;
determine that a peak has appeared when the acquired current value currently is equal to or lower than the current value acquired during a previous interval;
increase the duty ratio of the PTC heater by a predetermined amount when the heater control circuit has determined that a peak has appeared in the current value; and
gradually increase the current value of the PTC heater by increasing the duty ratio repeatedly until the duty ratio of the PTC heater becomes 100%.

2. An air conditioner according to claim 1, wherein
the heater control circuit is configured to increase the duty ratio of the PTC heater by a predetermined amount when the acquired current value is smaller than a first predetermined value, and
the heater control circuit is further configured to decrease the duty ratio of the PTC heater by a predetermined amount when the acquired current value is larger than a second predetermined value.

3. An air conditioner according to claim 1, further comprising an air blower for generating air flow toward the PTC heater,
wherein the air blower is driven at a first rotation speed when the PTC heater starts to be driven, and
wherein the air blower is driven at a second rotation speed higher than the first rotation speed when the duty ratio of the PTC heater reaches to 100%.

4. An air conditioner according to claim 3, wherein the air blower is reduced in rotation speed gradually from the first rotation speed until the duty ratio of the PTC heater reaches to 100%.

5. An air conditioner according to claim 1, wherein the heater control circuit carries out triac control on the PTC heater.

6. An air conditioner, comprising:
an indoor unit having an inlet and an outlet;
an indoor heat exchanger arranged in the indoor unit;
a blower duct connecting between the inlet and the outlet inside the indoor unit and forming a blower passage;
a blower fan arranged in the blower passage;
an outdoor unit having a housing;
an outdoor heat exchanger arranged in the housing;
an outdoor fan arranged in the housing;
a compressor connected to the indoor and outdoor heat exchangers via refrigerant pipe;
a power supply section;
a positive temperature coefficient (PTC) heater which starts to be driven at a predetermined duty ratio;
a heater control circuit for carrying out duty control on the PTC heater; and
the air conditioner delivering air heated by the PTC heater to a room, to thereby perform heating operation,
wherein the heater control circuit is configured to:
acquire, at predetermined intervals, a current value of the PTC heater that has started being driven at the predetermined duty ratio;
determine that a peak has appeared when the acquired current value currently is equal to or lower than a current value acquired during a previous interval,
increase the duty ratio of the PTC heater by a predetermined amount when the heater control circuit has determined that a peak has appeared in the current value when the acquired current value is smaller than a second predetermined value that is lower than a first predetermined value;
gradually increase the current value of the PTC heater by increasing the duty ratio repeatedly until the duty ratio of the PTC heater becomes 100%; and
decrease the duty ratio of the PTC heater by a predetermined amount when the acquired current value is larger than the first predetermined value, and
wherein, when the detected current value is larger than the second predetermined value but smaller than the first predetermined value, neither the heater control circuit increases the duty ratio of the PTC heater nor the heater control circuit decreases the duty ratio of the PTC heater.

* * * * *